US010267302B2

(12) United States Patent
Yoo et al.

(10) Patent No.: US 10,267,302 B2
(45) Date of Patent: Apr. 23, 2019

(54) LINEAR COMPRESSOR WITH SUCTION GUIDE

(71) Applicant: LG ELECTRONICS INC., Seoul (KR)

(72) Inventors: Kwangmyoung Yoo, Seoul (KR); Kyoungseok Kang, Seoul (KR); Sungtaek Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 384 days.

(21) Appl. No.: 15/084,702

(22) Filed: Mar. 30, 2016

(65) Prior Publication Data

US 2016/0341190 A1 Nov. 24, 2016

(30) Foreign Application Priority Data

May 21, 2015 (KR) ..... 10-2015-0070897

(51) Int. Cl.
*F04B 39/12* (2006.01)
*F04B 35/04* (2006.01)
*F04B 39/00* (2006.01)

(52) U.S. Cl.
CPC ..... *F04B 39/12* (2013.01); *F04B 35/045* (2013.01); *F04B 39/0027* (2013.01);
(Continued)

(58) Field of Classification Search
CPC .. F04B 39/12; F04B 39/0027; F04B 39/0061; F04B 35/045; F04B 39/0016; F05C 2201/021
(Continued)

(56) References Cited

U.S. PATENT DOCUMENTS 1,655,018 A * 1/1928 Loutrel ..... F16B 39/24 411/157
5,882,416 A * 3/1999 Van Buskirk ..... C23C 16/448 118/715
(Continued)

FOREIGN PATENT DOCUMENTS

CN 101835979 9/2010
CN 203770066 8/2014
(Continued)

OTHER PUBLICATIONS

Chinese Office Action dated Sep. 29, 2017 issued in Application No. 201610312566.7 (with English translation).
(Continued)

*Primary Examiner* — Dominick L Plakkoottam
*Assistant Examiner* — Stephen A Mick
(74) *Attorney, Agent, or Firm* — Ked & Associates LLP

(57) ABSTRACT

A linear compressor is provided that may include a shell including a refrigerant suction inlet, a cylinder provided in the shell, a piston reciprocated in the cylinder, a suction muffler movable together with the piston, the suction muffler defining a refrigerant passage, a suction guide provided at one side of the piston to guide a refrigerant suctioned through the refrigerant suction inlet to the suction muffler, a back cover coupled to the suction guide, and a coupling guide provided in a space defined by the suction guide and the back cover to maintain a coupling force between the suction guide and the back cover.

22 Claims, 9 Drawing Sheets

(52) U.S. Cl.
CPC ..... *F04B 39/0061* (2013.01); *F04B 39/0016* (2013.01); *F05C 2201/021* (2013.01)

(58) Field of Classification Search
USPC ..... 417/312, 415, 416, 417
See application file for complete search history.

(56) References Cited

U.S. PATENT DOCUMENTS

| | | | | |
|---|---|---|---|---|
| 6,264,439 | B1 * | 7/2001 | Falk | A61M 5/14276 29/602.1 |
| 6,398,523 | B1 * | 6/2002 | Hur | F04B 35/045 417/312 |
| 2006/0250032 | A1 | 11/2006 | Her | |
| 2007/0241621 | A1 * | 10/2007 | Hyun | F04B 35/045 310/23 |
| 2010/0290936 | A1 | 11/2010 | Kang et al. | |
| 2015/0004025 | A1 | 1/2015 | Kang et al. | |

FOREIGN PATENT DOCUMENTS

| | | |
|---|---|---|
| CN | 203835681 | 9/2014 |
| EP | 2818712 | 12/2014 |
| KR | 10-2006-0081291 | 7/2006 |
| KR | 10-2007-0075887 | 7/2007 |
| KR | 10-2010-0112476 | 10/2010 |
| WO | WO 2002/084121 | 10/2002 |

OTHER PUBLICATIONS

European Search Report dated Oct. 7, 2016 issued in Application No. 16168568.0.

* cited by examiner

LINEAR COMPRESSOR WITH SUCTION GUIDE

CROSS-REFERENCE TO RELATED APPLICATION(S)

The present application claims priority under 35 U.S.C. 119 and 35 U.S.C. 365 to Korean Patent Application No. 10-2015-0070897, filed in Korea on May 21, 2015, which is hereby incorporated by reference in its entirety.

BACKGROUND

1. Field

A linear compressor is disclosed herein.

2. Background

In general, compressors are machines that receive power from a power generation device, such as an electric motor or turbine, to compress air, a refrigerant, or various working gases to increase a pressure thereof. Compressors are being widely used in home appliances, such as refrigerators or air conditioners, or industrial fields.

Compressors may be largely classified into reciprocating compressors, which a compression space into/from which a working gas, such as a refrigerant, is suctioned and discharged, is defined between a piston and a cylinder to allow the piston to be linearly reciprocated in the cylinder, thereby compressing the refrigerant, rotary compressors in which a compression space into/from which a working gas, such as a refrigerant, is suctioned and discharged, is defined between a roller that eccentrically rotates and a cylinder to allow the roller to eccentrically rotate along an inner wall of the cylinder, thereby compressing the refrigerant, and scroll compressors, in which a compression space into/from which a working gas, such as a refrigerant, is suctioned and discharged, is defined between an orbiting scroll and a fixed scroll to compress the refrigerant, while the orbiting scroll rotates along the fixed scroll. In recent years, a linear compressor, which is directly connected to a drive motor, in which a piston is linearly reciprocated, to improve compression efficiency without mechanical losses due to movement conversion and having a simple structure, is being widely developed.

In general, the linear compressor may suction and compress a refrigerant while the piston is linearly reciprocated in a sealed shell by a linear motor, and then discharge the refrigerant. The linear motor includes a permanent magnet to be disposed between an inner stator and are outer stator. The permanent magnet may be linearly reciprocated by an electromagnetic force between the permanent magnet and the inner (or outer) stator. Also, as the permanent magnet operates in a state in which the permanent magnet is connected to the piston, the refrigerant may be suctioned and compressed while the permanent magnet is linearly reciprocated within the cylinder, and then the refrigerant may be discharged.

The linear compressor includes a muffler that defines a refrigerant passage through which the refrigerant passes to reduce noise, a suction pipe that guides introduction of the refrigerant into the muffler, and a back cover that supports the suction pipe. The present Applicant has filed a patent application (hereinafter, referred to as a ("prior document") with respect to the linear compressor according to the related art, Korean Publication No. 10-2006-0081291, which is hereby incorporated by reference.

A linear compressor according to the related art includes a back cover provided with a suction pipe, and a muffler that guides a fluid suctioned through the suction pipe to an inner passage and reduces noise. The back cover may be coupled to a second spring disposed between a flange and the back cover, and thus, be elastically supported by the second spring. While the linear compressor is driven, a large load may be applied to the back cover by elastic force through the second spring or vibration of a linear motor.

According to the related art, the suction pipe may be coupled to the back cover using a coupling member or be attached to the back cover using an adhesive. In this case, the suction pipe may be damaged by a load transferred from the back cover or separated from the back cover. Also, as the suction pipe and the back cover are respectively formed of materials different from each other, for example, as the suction pipe is formed of a light plastic material, and the back cover is formed of a heavy magnetic material, when the suction pipe and the back cover are coupled to each other using the coupling member, the suction pipe may be damaged by the coupling force.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
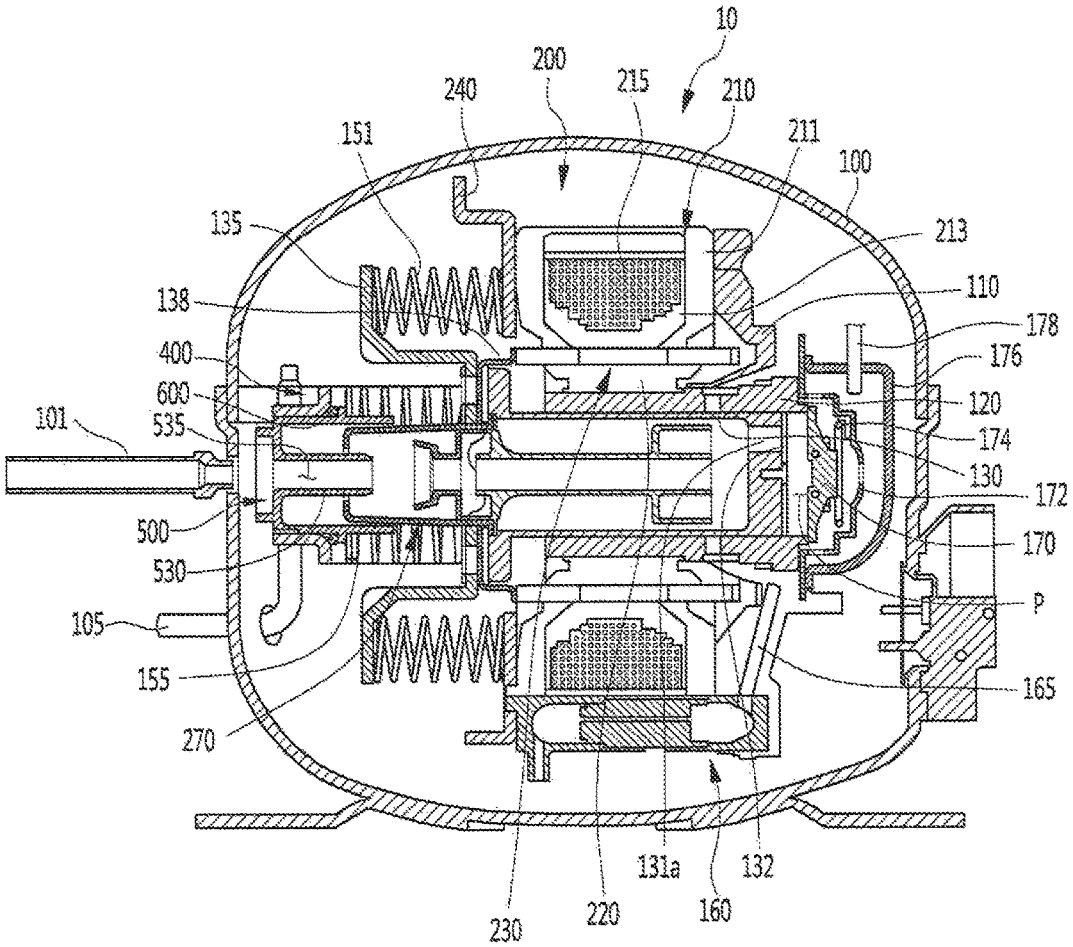
FIG. 1 is a cross-sectional view of a linear compressor according to an embodiment.

FIG. 1 is a cross-sectional view of a linear compressor according to an embodiment. Referring to FIG. 1, a linear compressor 10 according to an embodiment may include a cylinder 120 provided in a shell 100, a piston 130 linearly reciprocated within the cylinder 120, and a motor 200 that applies a drive force to the piston 130. The shell 100 may be formed by coupling an upper shell to a lower shell. Thus, the motor 200 may be referred to as a "linear motor".

The cylinder 120 may be formed of an aluminum material, such as aluminum or an aluminum alloy, which is a nonmagnetic material. As the piston 120 may be formed of the aluminum material, magnetic flux generated in the motor assembly 200 may be prevented from leaking outside of the cylinder 120 by being transmitted into the cylinder 120. Also, the cylinder 120 may be manufactured by an extruding rod processing process, for example.

The piston 130 may be formed of an aluminum material, such as aluminum or an aluminum alloy, which is a non-magnetic material. As the piston 130 is formed of the aluminum material, magnetic flux generated in the motor assembly 200 may be prevented from leaking outside of the piston 130 by being transmitted into the piston 130. Also, the piston 130 ray be manufactured by a forging process, for example.

The cylinder 120 and the piston 130 may have a same material composition, that is, a same kind and composition. As the piston 130 is formed of the same material, for example, aluminum, as the cylinder 120, the piston 130 may have a same thermal expansion coefficient as the cylinder 120. While the linear compressor 10 is driven, a high-temperature, that is, a temperature of about 100° C., environment may be created within the shell 100. Thus, as the piston 130 and the cylinder 120 have the same thermal expansion coefficient the piston 130 and the cylinder 120 may be thermally deformed by a same degree. As a result, the piston 130 and the cylinder 120 may be thermally deformed with sizes different from each other and in directions different from each other to prevent the piston 130 from interfering with the cylinder 120 while the piston 430 moves.

The shell 100 may include a suction inlet 101, through which a refrigerant may be introduced, and a discharge outlet 105, through which the refrigerant compressed in the cylinder 120 may be discharged. The refrigerant suctioned through the suction inlet 101 may flow into the piston 130 via a suction muffler 270. Thus, while the refrigerant passes through the suction muffler 270, noises having various frequencies may be reduced.

The cylinder 120 may have a compression space P, in which the refrigerant may be compressed by the piston 130. A suction hole 131*a*, through which the refrigerant may be introduced into the compression space P, may be defined in the piston 130, and a suction valve 132 that selectively opens the suction hole 131*a* may be provided on or at one side of the suction hole 131*a*.

A discharge valve assembly 170, 172, and 174 to discharge the refrigerant compressed in the compression space P may be provided on or at one side of the compression space P. That is, the compression space P may be a space defined between an end of the piston 130 and the discharge valve assembly 170, 172, and 174.

The discharge valve assembly 170, 172, and 174 may include a discharge cover 172 that defines a discharge space for the refrigerant, a discharge valve 170, which may be opened when a pressure in the compression space P is above a discharge pressure to introduce the refrigerant into the discharge space, and a valve spring 174 provided between the discharge valve 170 and the discharge cover 172 to apply an elastic force in an axial direction. The term "axial direction" may be refer to a direction in which the piston 130 is reciprocated, that is, a transverse direction in FIG. 1.

The suction valve 132 may be provided on or at one or a first side of the compression space P, and the discharge valve 170 may be provided on the other or a second side of the compression space P, that is a side opposite of the suction valve 132. While the piston 130 is linearly reciprocated within the cylinder 120, when the pressure of the compression space P is below the discharge pressure and a suction pressure, the suction valve 132 may be opened to suction the refrigerant into the compression space P. On the other hand, when the pressure of the compression space P is above the suction pressure, the suction valve 132 may compress the refrigerant of the compression space P in a state in which the suction valve 135 is closed.

When the pressure of the compression space P is above the discharge pressure, the valve spring 174 may be deformed to open the discharge valve 170. The refrigerant may be discharged from the compression space P into the discharge space the discharge cover 172.

The refrigerant in the discharge space may be introduced into a loop pipe 178 via a discharge muffler 176. The discharge muffler 176 may reduce flow noise of the compressed refrigerant, and the loop pipe 178 may guide the compressed refrigerant into the discharge outlet 105. The loop pipe 178 may be coupled to the discharge muffler 176 to extend in a curved shape and then be coupled to the discharge outlet 105.

The linear compressor 10 may further include a frame 110. The frame 110 may fix the cylinder 120 and be integrated with the cylinder 120 or may be coupled to the cylinder 120 using a separate coupling member, for example. The discharge cover 172 and the discharge muffler 176 may be coupled to the frame 110.

The motor 200 may include an outer stator 210 fixed to the frame 110 and provided to surround the cylinder 120, an inner stator 220 spaced inward from the outer stator 210, and a permanent magnet 230 provided in a space between the outer stator 210 and the inner stator 220. The permanent magnet 230 may be lineally reciprocated by mutual electromagnetic force between the outer stator 210 and the inner stator 220. The permanent magnet 230 may be a single magnet having one polarity, or a plurality of magnets having three polarities. The permanent magnet 230 may be formed of a ferrite material, which is relatively inexpensive.

The permanent magnet 230 may be coupled to the piston 130 by a connection member 138. The connection member 138 may extend from an end of the piston 130 to the permanent magnet 230. As the permanent magnet 230 linearly moves, the piston 130 may be linearly reciprocated in the axial direction together with the permanent magnet 230.

The outer stator 210 may include coil winding bodies 213 and 215 and a stator core 211. The coil winding bodies 213 and 215 may include a bobbin 213, and a coil 215 wound in a circumferential direction of the bobbin 213. The coil 215 may have a polygonal cross-section, for example, a hexagonal cross-section. The stator core 211 may be manufactured by stacking a plurality of laminations in the circumferential direction and be may surround the coil winding bodies 213 and 215.

When current is applied to the motor 200, the current may flow through the coil 215, and magnetic flux may be formed around the coil 215 by the current flowing through the coil 215. The magnetic flux may flow while forming a closed circuit along the outer stator 210 and the inner stator 220. The magnetic flux may flow along the outer stator 210 and the inner stator 220, and may interact with the magnetic flux of the permanent magnet 230 to generate a force to move the permanent magnet 230.

A stator cover 240 may be provided on or at one side of the outer stator 210. One or a first end of the outer stator 210 may be supported by the frame 110, and the other or a second end of the outer stator 210 may be supported by the stator cover 240. Thus, the stator cover 240 may be referred to as a "motor cover".

The inner stator 220 may be fixed to a circumference of the cylinder 120. Also, in the inner stator 220, the plurality of laminations may be stacked in the circumferential direction outside of the cylinder 120.

The linear compressor 10 may further include a support 135 that supports the piston 130, and a back cover 400 provided at a front of the support 135 and coupled to the stator cover 240. The support 135 may be coupled to an outside of the connection member 138. The back cover 400 may be provided to cover at least a portion of the suction muffler 140.

The linear compressor 10 may further include a suction guide 500 coupled to the back cover 400. The suction guide 500 may guide the refrigerant suctioned through the suction inlet 101 to the suction muffler 270.

The suction guide 500 may be coupled to the back cover 400 and extend backwards. While the piston 130 and the suction muffler 270 are linearly reciprocated the suction guide 500 may be disposed near to the suction muffler 270 or away from the suction muffler 270.

The linear compressor 10 may further include a coupling guide 600 provided in a space between the back cover 400 and the suction guide 500 to allow the suction guide 500 to be more firmly coupled to the back cover 400. The linear compressor 10 may include a plurality of springs 151 and 155 that serves as elastic members and which is adjustable in natural frequency to allow the piston 130 to perform a resonant motion.

The plurality of springs 151 and 155 may include a first spring 151 supported between the support 135 and the stator cover 240 and a second spring 155 supported between the support 135 and the back cover 400. The first spring 151 and the second spring 155 may have a same elastic coefficient. A plurality of the first spring 151 may be provided on upper and lower sides of the cylinder 120 or the piston 130, and a plurality of the second spring 155 may be provided at a front of the cylinder 120 or the piston 130.

The term "frontward direction" may refer to a direction from the piston 130 toward the suction inlet 101. A direction from the suction inlet 101 toward the discharge valve assembly 170, 172, and 174 may be referred to as a "rearward direction." That is, the front side (or upstream) and the rear side (or downstream) may be defined based on a flow direction of the refrigerant. Also, a radial direction may a direction perpendicular to the front and rear sides. These terms may be equally applied to the following descriptions.

Oil may be stored on a bottom surface within the shell 100. An oil supply device 160 that pumps the oil may be provided in a lower portion of the shell 100. The oil supply device 160 may operate by vibration, which may be generated as the piston is linearly reciprocated, to pump the oil upward.

The linear compressor 10 may further include an oil supply tube 165 that guides a flow of the oil from the oil supply device 160. The oil supply tube 165 may extend from the oil supply device 160 to a space between the cylinder 120 and the piston 130. The oil pumped from the oil supply device 160 may be supplied into the space between the cylinder 120 and the piston 130 via the oil supply tube 165 to perform cooling and lubrication operations.

Figure 2:
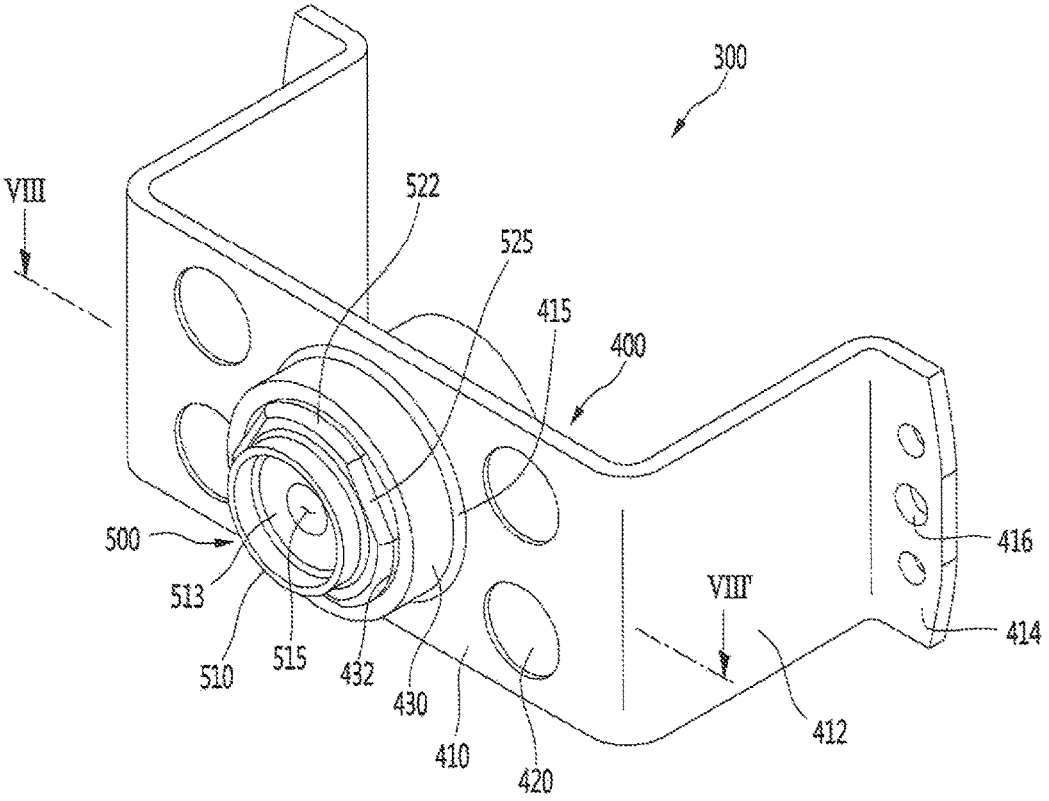
FIG. 2 is a perspective view of a back cover assembly according to an embodiment.
Figure 3:
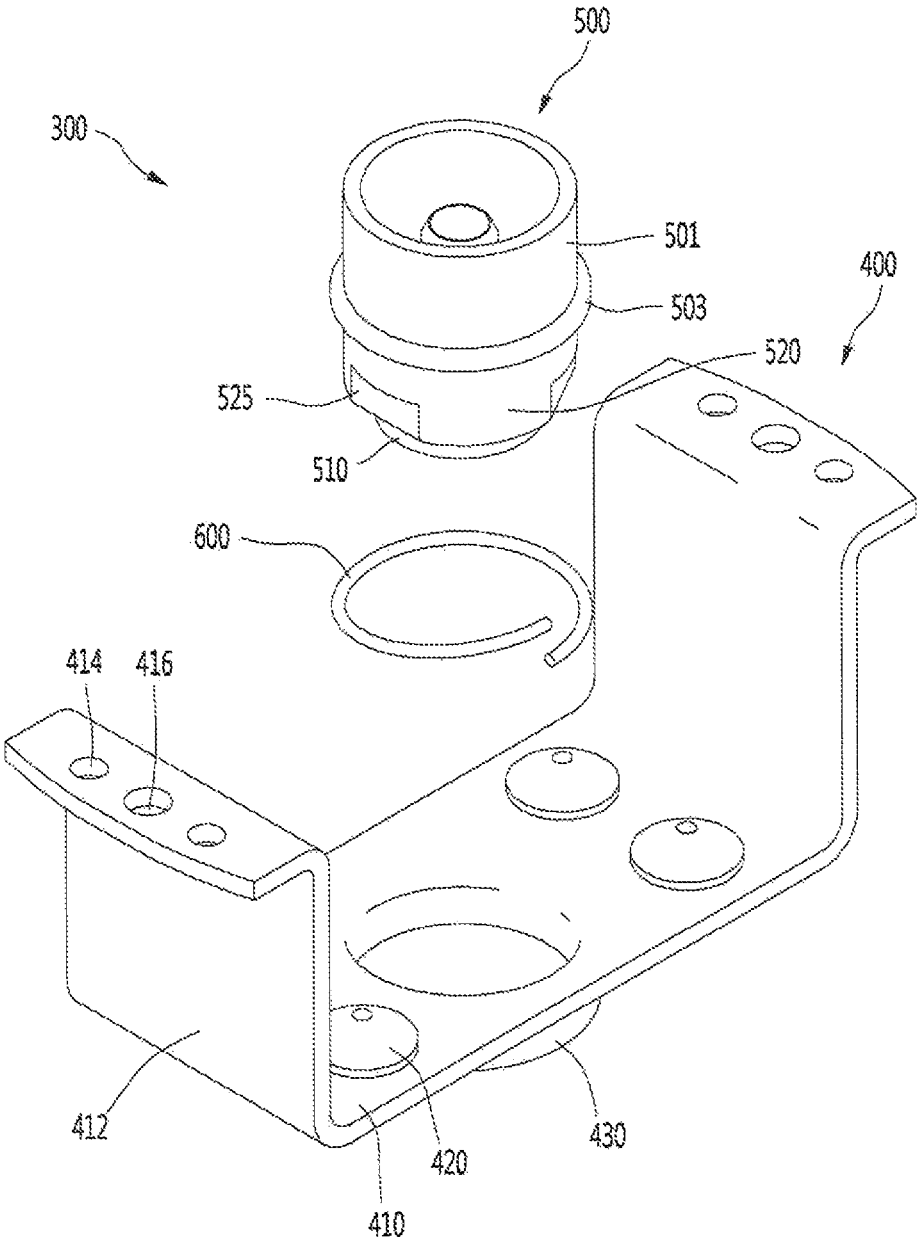
FIG. 3 is an exploded perspective view of the back cover assembly according to an embodiment.
Figure 4:
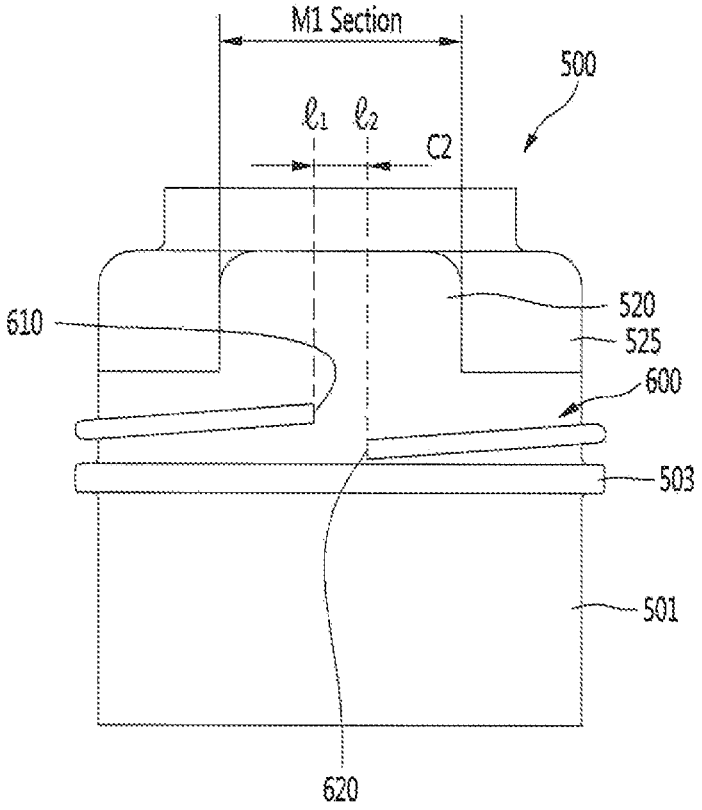
FIG. 4 is a view illustrating a coupled state between a suction guide and coupling guide according to an embodiment.

FIG. 2 is a perspective view of a back cover assembly according to an embodiment. FIG. 3 is an exploded perspective view of the back cover assembly according to an embodiment. FIG. 4 is a view illustrating a coupled state between a suction guide and a coupling guide according to an embodiment.

Referring to FIGS. 2 to 4, a back cover assembly 300 according to an embodiment may include the back cover 400, the suction guide 500, and the coupling guide 600 that guides firm coupling between the back cover 400 and the suction guide 500. The suction guide 500 may be formed of a material formed by mixing a plastic material and a glass fiber. For example, the plastic material may include a polybutylene terephtalate (TBT) resin. Also, the back cover 400 may be formed of a metal material, which is a magnetic material.

The back cover 400 may include a cover body 410, into which the suction guide 500 may be inserted and extending in a radial direction, an extension 412 bent backward from both sides of the cover body 410, and a coupling portion 414 that extends from the extension 412 outwardly in a radial direction and coupled to the stator cover 240. At least one coupling hole 416, through which a coupling member (not shown) coupled to the stator cover 240 may pass, may be defined in the coupling portion 414.

A plurality of spring supports 420, by which the second spring 155 may be supported may be provided on the cover body 410. Each of the plurality of spring supports 420 may protrude backward from the cover body 410. For example, the spring support 420 may have a cone shape so that the respective spring support 420 may be coupled to one end of the respective second spring 155.

The back cover 400 may include a press-fit portion 430 that protrudes forward from the cover body 410. The press-fit portion 430 may have an approximately hollow cylindrical shape. An insertion space 432, into which the suction guide 500 may be inserted, may be defined in the press-fit portion 430.

The suction guide 500 may include a guide body 501 having an approximately hollow cylindrical shape, a protrusion guide 510 that protrudes forward from the guide body 510 to guide a refrigerant suctioned through the suction inlet 101 to the suction muffler 270, and a stopper 503 that protrudes from an outer circumferential surface of the guide body 501 in a radial direction. The protrusion guide 510 may have an approximately hollow cylindrical shape and may be provided close to the suction inlet 101 to guide the refrigerant suctioned through the suction inlet 101 to an inner space of the protrusion guide 510. The protrusion guide 510 may extend from the guide body 501 to the suction inlet 101 to accommodate the refrigerant.

A front surface 513 that defines an inflow hole 515 may be coupled to the protrusion guide 510. The front surface 513 may extend inward from rear end of the protrusion guide 510 in the radial direction and have an approximately disc shape. The inflow hole 515 may pass through a central portion of the front surface 513.

The refrigerant suctioned through the suction inlet 101 may be guided to the inner space of the protrusion guide 510 to pass through the inflow hole 515 and flow backward to the suction muffler 270. As the inflow hole 515 has a diameter less than a diameter of the protrusion guide 510, the refrigerant may increase in flow rate while flowing from the protrusion guide 510 to the inflow hole 515.

The stopper 503 may be provided on or at an approximately central portion with respect to a longitudinal direction (a front/rear direction) of the guide body 501 to surround an outer circumferential surface of the guide body 501. When the suction guide 500 is coupled to the back cover 400, the stopper 503 may be hooked with the back cover 400 to limit an insertion distance of the suction guide 500.

The suction guide 500 may be forcibly press-fitted into the back cover 400 to be coupled to the back cover 400. The guide body 501 may include a press-fit corresponding portion 520 inserted into the press-fit portion 430 and pushed by the press-fit portion 430, and a deformation portion 525 that secures a deformation space while the press-fit corresponding to 520 is inserted into the press-fit portion 430 and then deformed.

The deformation portion 525 may have a shape which is recessed inward from the press-fit corresponding portion 520. A distance from an inner central portion of the guide body 501 having the cylindrical shape to the deformation portion 525 may be less than a distance from the inner central portion to an outer surface of the press-fit corresponding portion 520. Thus, the deformation portion 525 may be a portion which is not pushed by the press-fit portion 430.

The press-fit portion 520 may be rounded at a predetermined curvature radius at a front portion of the guide body 501. The press-fit corresponding portion 520 may be a portion that forms at least a portion of the guide body 501. A plurality of the press-fit corresponding portion 520 may be provided, which may be spaced apart from each other.

The deformation portion 525 may be provided between the plurality of press-fit corresponding portions 520 to linearly extend in a straight surface shape. The deformation portion 525 may be a portion formed by linearly cutting an outer circumferential surface of the guide body 501 by a predetermined portion. Also, a plurality of the deformation portion 525 may be provided. The deformation portion 525 may have a straight surface shape.

The guide body 501 may further include a hook 522 that extends forward from the press-fit corresponding portion 520 and hooked with an outside of the press-fit portion 430. The hook 522 may be provided on an end of the guide body 501. That is, the press-fit corresponding portion 520 may be a portion inserted into the press-fit portion 430 when the suction guide 500 is coupled to the back cover 400. The hook 522 may be a portion that protrudes to the outside of the press-fit portion 430.

The suction guide 500 may further include a flow guide 530 that extends backward from the inflow hole 515 toward the suction muffler 270. A refrigerant passage 535, through which the refrigerant may flow, may be defined in the flow guide 530.

The coupling guide 600 may surround an outer circumferential surface of the press-fit corresponding portion 520. While the suction guide 500 is coupled to the back cover 400, the coupling guide 600 may be provided in a space at which the stopper 503 is hooked with the back cover 400.

Figure 6:
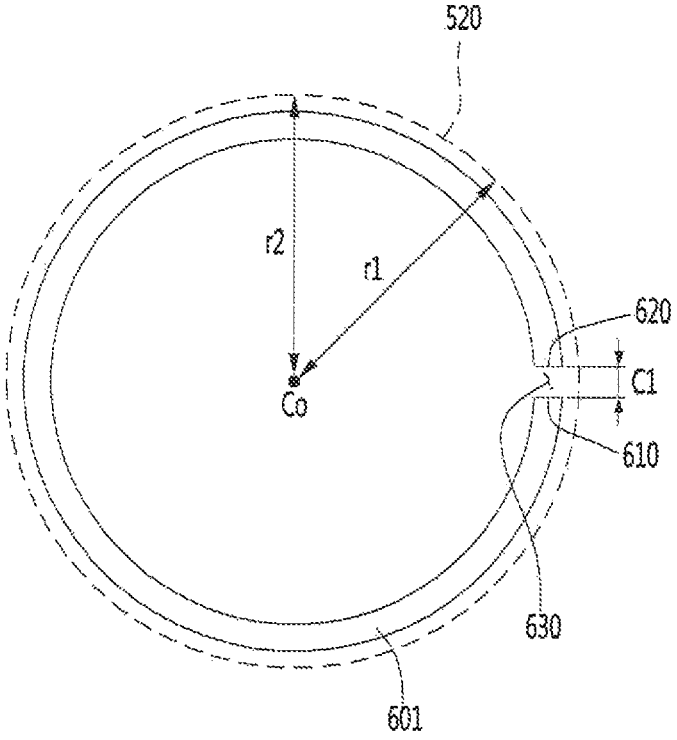
FIG. 6 is a view for comparing diameters of the coupling guide and the suction guide with each other according to an embodiment.

The coupling guide 600 may have a ring shape that defines an opening (see reference numeral 630 of FIG. 6). The opening 630 may be a cut space, which may be defined between both ends 610 and 620 of the coupling guide 600.

In a state in which the coupling guide 600 is coupled to the back cover 400, both ends 610 and 620 of the doubling guide 600 may be provided on the outer circumferential surface of the press-fit corresponding portion 520, which does not pass through the deformation portion 525 in a front/rear direction A virtual line l1 in the front/rear direction, which passes through a first end 610 of the coupling guide 600 and a virtual line l2 in the front/rear direction, which passes through a second end 620 may not meet the deformation portion 525. That is, the virtual line (l1 and l2) may pass through a section M1 of FIG. 4.

Thus, in a state in which the coupling guide 600 surrounds the outer circumferential surface of the suction guide 500, when the compressor 10 is driven to allow the suction guide 500 or the coupling guide 600 to move forward, both ends 610 and 620 may not be provided on the deformation portion 525 to prevent a coupling and supporting force of the coupling guide 600 from being reduced.

Both ends 510 and 620 of the coupling guide 600 may be provided positions different from each other in the front/rear direction, that is, at heights different from each other in a vertical direction in FIG. 4. When the coupling, guide 600 is coupled to the back cover 400, the coupling guide 600 may be pressed to the stopper 503, and a force for closely attaching the suction guide 500 or the back cover 400 to an installation space may act by a restoring force.

A coupling operation of the back cover assembly 300 will be described hereinbelow.

The coupling guide 600 may be provided on the outer circumferential surface of the suction guide 500. The suction guide 500 may move from a rear side to a front side of the cover body 410 to allow the protrusion guide 510 to be inserted into the press-fit portion 430.

The protrusion guide 510 may have an outer diameter less than an inner diameter of the press-fit portion 430. Thus, the protrusion guide 510 may pass through the press-fit portion 430 to move to a front side of the press-fit portion 430.

The guide body 501 may have an outer diameter, which is slightly less than the inner diameter of the press-fit portion 430. Thus, while the guide body 501 is inserted into the press-fit portion 430, the guide body 501 may interfere with the press-fit portion 430 to apply a predetermined force or more to the press-fit portion 430. As a result, the press-fit portion 430 may be press-fitted (forcibly press-fitted).

The press-fit corresponding portion 520 may be deformed to decrease in size while passing through an inside of the press-fit portion 430. The deformation portion 525 may secure an available space for deforming the press-fit corresponding portion 520.

The suction guide 500 may move up to a position at which the stopper 503 interferes with the back cover 400. The coupling guide 600 may be provided on the outer circumferential surface of the press-fit corresponding portion 520 and in the space (hereinafter, referred to as an "installation space") defined by the stopper 503 and the back cover 400.

When he coupling guide 600 is provided in the installation space, a force for closely attaching the coupling guide 600 to the suction guide 500 or the back cover 400 may be applied by the restoring force of the coupling guide 600. Thus, the coupling and supporting force between the suction guide 500 and the back cover 400 may be maintained.

When the coupling between the suction guide 500 and the back cover 400 is completed, the press-fit corresponding portion 520 may be provided in a state in which the press-fit corresponding portion 520 is deformed to the inside of the press-fit portion 430. Also, the hook 522 may protrude to the outside of the press-fit portion 430 and be hooked with an end of the press-fit portion 430.

In a manufacturing process of the compressor 10, when assembly of the back cover assembly 300 and assembly of the compressor 10 are completed, a painting process for preventing the compressor 10 from rusting may be performed on the compressor 10. For example, the painting process may include a process of applying paint on an outer surface of the shell 100 and drying the paint. A drying furnace, into which the compressor 10 may be placed, may have a high-temperature environment, for example, a temperature of about 190° C. to about 200° C.

In the drying process, the suction guide 500 may be thermally expanded. After the drying process is completed, the suction guide 500 may contract again, and thus, the coupling force (the press-fitting force) between the suction guide 500 and the back cover 400 may be reduced.

If the compressor 10 is driven in a state in which the coupling force is reduced, a gap between the suction guide 500 and the back cover 400 may increase due to vibration of the shell 100, and thus, the suction guide 500 may be separated from the back cover 400. In addition, in the state in which the coupling force is reduced, when the compressor 10 is driven noise may occur.

Thus, in this embodiment, the coupling guide 600 may be provided on or at the portion at which the back cover 400 and the suction guide 500 are coupled to each other to compensate for stress due to thermal deformation of the suction guide 500 or an inertial force generated while the compressor 10 is driven. Hereinafter, components of the coupling guide 600 will be described with reference to the accompanying drawings.

Figure 5:
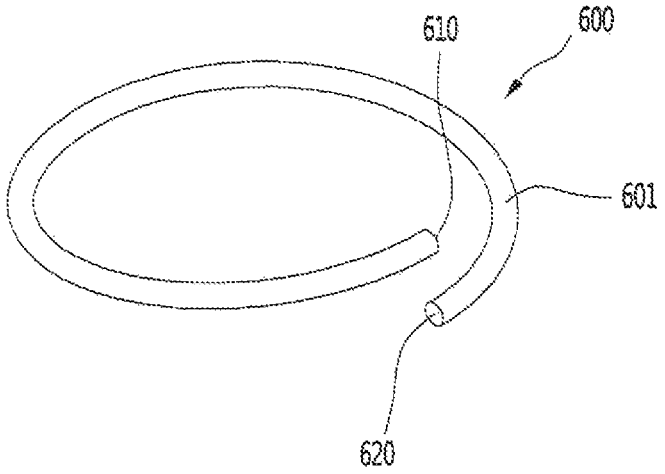
FIG. 5 is a view of the coupling guide according to an embodiment.
Figure 7:
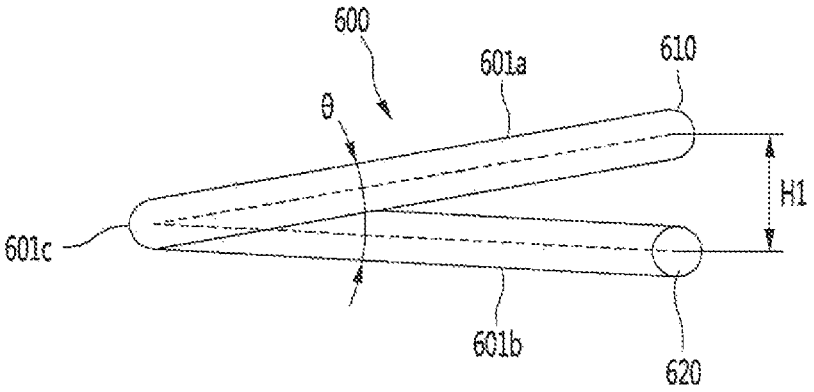
FIG. 7 is a side view of the coupling guide according to an embodiment.

FIG. 5 is a view of the coupling guide according to an embodiment. FIG. 6 is a view for comparing diameters of the coupling guide and the suction guide with each other according to an embodiment. FIG. 7 is a side view of the coupling guide accord to an embodiment.

Referring to FIGS. 5 to 7, the coupling guide 600 according to an embodiment may include a guide body 601, which may be curved to have a preset or predetermined curvature radius and having both ends 610 and 620. The opening 630 may be defined between the ends 610 and 620 of the guide body 601. That is, the guide body 610 may have an approximately ring shape, at least a portion of which may be cut.

The ends 610 and 620 may include a first end 610 that defines one end of the guide body 601, and a second end 620 that defines the other end. When the coupling guide 600 is viewed from an upper side, the first end 610 may be spaced a preset or predetermined distance C1 from the second end 620. The coupling guide 600 may have a radius r1 less than a radius r2 of the press-fit corresponding portion 520 of the suction guide 500.

Thus, when the coupling guide 600 is provided on the outer circumferential surface of the suction guide 500, the coupling guide 600 may be deformed so that a distance between the first and second ends 610 and 620 increases, that is, the coupling guide 600 may increase in diameter. Thus, when the coupling guide 600 is installed on the suction guide 500, a distance C2 (see FIG. 4) between the first and second ends 610 and 620 may be greater than the distance C1.

The coupling guide 600 may include an elastic spring having a preset or predetermined elastic coefficient. For example, the coupling guide 600 may be formed of a carbon steel wire. That carbon steel wire is a material used for piano wire is well known. The coupling guide 600 may be referred to as an "elastic spring".

The guide body 601 may include a first body portion 601*a* that extends in a first direction and a second body portion 601*b* that extends in a second direction with respect to an inflection portion 601*c*. That is, the inflection portion 601*c* may be a portion provided between the first body portion 601*a* and the second body portion 601*b* that switches from the one direction to the other direction. The first end 610 may be an end of the first body portion 601*a*, and the second end 620 may be an end of the second body portion 601*b*.

The guide body 601 may be configured such that the first and second ends 610 and 620 are dislocated with respect to each other. That is, the guide body 601 may be provided in a twisted shape, such that the first and second ends 610 and 620 are provided at heights different from each other.

The first body portion 601*a* and the second body portion 601*b* may extend to have a preset or predetermined angle θ therebetween with respect to the inflection portion 601*c*. That is, a line that extends from the inflection portion 601*c* to the first end 610 and a line that extends from the inflection portion 610*c* to the second end 620 may have the predetermined angle θ therebetween. The predetermined angle θ may be less than about 90°. For example, the predetermined angle θ may range from about 15° to about 45°. Also, the first and second ends 610 and 620 may have a preset or predetermined height difference H1 therebetween in the front/rear direction.

As described above, in a state in which the coupling guide 600 having the twisted shape is coupled to the suction guide 500, when the coupling guide 600 is inserted into the back cover 400, the coupling guide 600 may be pressed by the stopper 503, and thus, may be disposed in the space (the installation space) defined by the stopper 503 and the back cover 400. Also, as the restoring force is applied to the coupling guide 600, the coupling guide 600 may be closely attached to the suction guide 500 or the back cover 400. Thus, the coupling and supporting force between the suction guide 500 and the back cover 400 may be maintained through or by the coupling guide 600.

Figure 8:
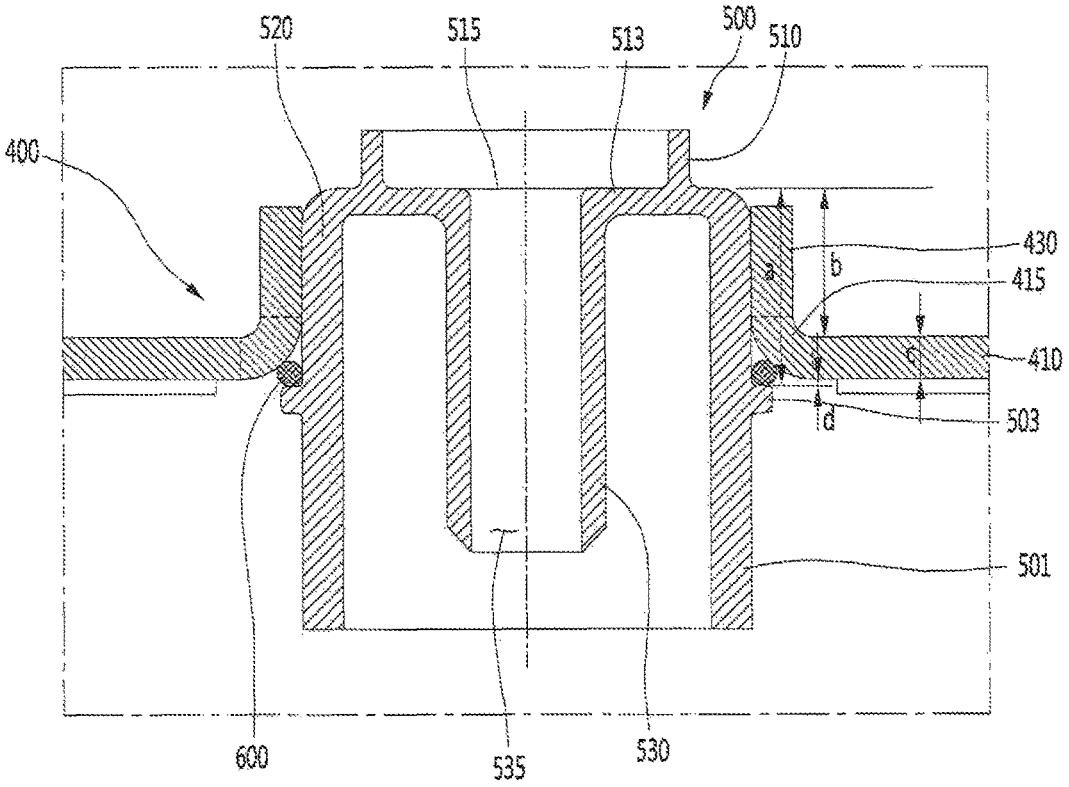
FIG. 8 is a cross-sectional view, taken along line VIII-VIII' of FIG. 2.

FIG. 8 is a cross-sectional view, taken along line VIII-VIII' of FIG. 2. Referring to FIG. 8, the coupling guide 600 according to an embodiment may be installed in the space defined by the suction guide 500 and the back cover 400.

The back cover 400 may include the cover body 410 that extends in the radial direction, the press-fit portion 430 that extends forward from the cover body 410, and the bending portion 415 that connects the cover body 410 to the press-fit portion 430. The bending portion 415 may extend to be rounded at a preset or predetermined curvature from the cover body 410 toward the press-fit portion 430. The coupling guide 600 may be provided on or at one side of the bending portion 415.

The coupling guide 600 may be provided in the space, which is defined by the press-fit corresponding portion 520, the stopper 503, and the bending portion 415, that is, in the installation space. The space may be defined between the stopper 503 and the bending portion 415 by components of the bending portion 415. The space may be a space, which may be defined by a gap d. The gap d may be determined by a value of the following equation: a−b−c, where a is a distance from the front surface 513 to a rear surface of the cover body 410, b is a distance from the front surface 513 to a front surface of the cover body 410, and c is a thickness of the cover body 410.

When the suction guide 500 is thermally deformed, there is a limitation in that the space provides an available space in which the suction guide 500 may be movable. Thus, as the coupling guide 600 having the elastic force is provided in the space, the suction guide 500 may be more stably and firmly coupled to the back cover 400.

Figure 9:
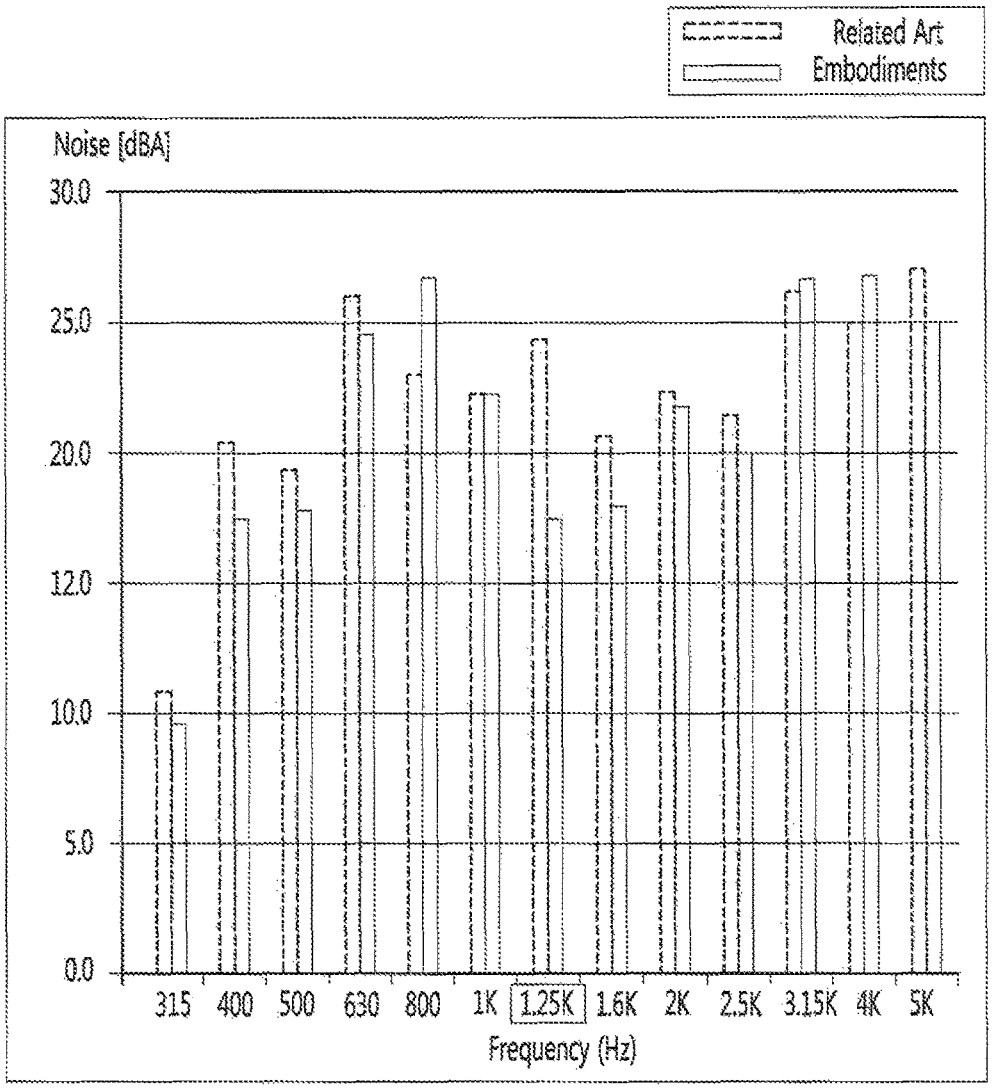
FIG. 9 is a graph illustrating a noise reduction effect when a back cover assembly is provided in the compressor according to an embodiment.

FIG. 9 is a graph illustrating a noise reduction effect when the back cover assembly is provided in the compressor according to an embodiment. FIG. 9 illustrates experimental data obtained by experimenting with intensity of noises generated when noises having various frequencies pass through the back cover assembly.

When comparing results obtained by allowing noises having various bands to pass through the back cover assembly including the coupling guide 600 according to this embodiment and a back cover assembly, which does not include the coupling guide 600, according to the related art, it is seen that the intensity of the noise, which is measured in the back cover assembly according to this embodiment, is relatively low. More particularly, in the intensity of the noise having a frequency corresponding to a resonance region, for example, a frequency of about 1.25 KHz, it is seen that the intensity of the noise in this embodiment is significantly lower than the intensity of the noise in the related art due to the structure of the suction guide 500.

Thus, when the coupling guide 600 according to this embodiment is installed, the suction guide 500 and the back cover 400 may be stably coupled to each other. Therefore, when the compressor 10 is driven, the occurrence of noise due to unstable behavior of the suction guide 500 may be prevented.

According to one embodiment, the coupling guide may be provided on or at the portion at which the back cover and the suction guide are coupled to each other to prevent the suction guide from being shaken and separated from the back cover. While the suction guide is thermally expanded and contracted, the coupling guide may be provided at the position at which the coupling force with the back cover is reduced, for example, in the space defined by the press-fit corresponding portion, the stopper, and the bending portion of the back cover to improve the coupling force between the suction guide and the back cover. Also, the coupling guide may have the ring shape, and thus, the coupling guide may be easily installed in the space.

Further, the coupling guide may include the steel wire having a predetermined elastic force. As the coupling guide has the twisted shape so that ends thereof have heights different from each other, the coupling guide may be closely attached to the stopper of the action guide after the coupling guide is pressed while being installed in the space.

Furthermore, as the coupling guide has the inner diameter less than the outer diameter of the suction guide, when the coupling guide is installed in the space, both ends of the coupling guide may be spaced apart from each other to prevent both ends of the coupling guide from interfering with each other while the compressor is driven. Additionally, as the suction guide is forcibly press-fitted into the back cover, the back cover and the suction guide may be firmly coupled to each other. Also, as the back cover and the suction guide are firmly coupled to each other, it may prevent the suction guide from being damaged by friction between the back cover and the suction guide, which occurs when coupling between the back cover and the suction guide is released while the linear compressor is driven.

Embodiments disclosed herein provide a linear compressor in which a back cover and a suction guide may be firmly coupled to each other.

According to one embodiment disclosed herein, a linear compressor is provided that may include a shell including a refrigerant suction part or inlet; a cylinder disposed or provided in the shell; a piston that is reciprocated in the cylinder; a suction muffler that is movable together with the piston, the suction muffler defining a refrigerant passage; a suction guide device or guide disposed or provided on or at one side of the piston to guide a refrigerant suctioned through the refrigerant suction part to the suction muffler; a back cover coupled to the suction guide device; and a coupling guide member or guide disposed or provided in a space defined by the suction guide device and the back cover to maintain a coupling force between the suction guide device and the back cover. The coupling guide member may be disposed or provided on an outer circumferential surface of the suction guide device.

The coupling guide member may have a ring shape to surround the suction guide device. The coupling guide member may have both cut ends. An opening may be defined between both cut ends.

The coupling guide member may include a first body part or portion that extends in one direction; a second body part or portion that extends in the other direction; and an inflection part or portion that switches a direction from the first body part to the second body part. Both ends may include a first end that defines an end of the first body part, and a second end that defines an end of the second body part. A line that extends from the inflection part to the first end, and a line extending from the inflection part to the second and may have a preset or predetermined angle θ therebetween, and the preset angle θ may be less than about 90°.

The coupling guide member may include an elastic spring. The coupling guide member may be formed of a steel wire.

The back cover may include a cover body having an insertion hole into which the suction guide device may be inserted, the cover body extending in one a first direction; a press-fit part or portion that extends from the cover body in the other or a second direction and into which at least a portion of the suction guide device may be forcibly press-fitted; and a bending part or portion that extends at a preset or predetermined curvature from the cover body to the press-fit part. The coupling guide member may be disposed or provided on or at one side of the bending part.

The suction guide device may include a guide body having a cylindrical shape; a press-fit corresponding part or portion that defines at least a portion of an outer circumferential surface of the guide body, the press-fit corresponding part being pushed by the press-fit part; and a stopper disposed or provided on the outer circumferential surface of the guide body to limit a distance by which the guide body is inserted through the insertion hole. The coupling guide member may be disposed or provided in a space defined by the press-fit corresponding part, the stopper, and the bending part. The coupling guide member may have both cut ends, and both ends of the coupling guide member may be disposed or provided on an outer circumferential surface of the press-fit corresponding part.

According to another embodiment disclosed herein, a linear compressor is provided that may include a shell; a cylinder disposed or provided in the shell; a piston that is reciprocated in the cylinder; a suction muffler that is movable together with the piston, the suction muffler defining a refrigerant passage; a suction guide device or guide disposed or provided on one side of the piston to guide a refrigerant to the suction muffler; a back cover coupled to the suction guide device, the back cover including a bending part or portion that extends to be rounded at a preset or predetermined curvature; a stopper disposed or provided in the suction guide device, the stopper being hooked with the back cover; and a coupling guide member or guide disposed or provided to surround an outer circumferential surface of the suction guide device. The coupling guide member may be disposed or provided in a space between the stopper and the bending part.

The coupling guide member may have a cut ring shape. The coupling guide member may have a twisted shape with respect to both cut ends thereof. The coupling guide member may include an elastic spring or steel wire. When the piston is reciprocated in a front/rear direction, the suction guide device may be near to the suction muffler or away from the suction muffler.

Any reference in this specification to "one embodiment," "an embodiment," "example embodiment", etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:
- a shell including a suction inlet;
- a cylinder provided within the shell;
- a piston reciprocated in the cylinder;
- a suction muffler movable together with the piston and having a refrigerant passage;
- a suction guide having a portion provided between the suction inlet and the suction muffler, the suction guide being configured to guide a refrigerant suctioned through the refrigerant suction inlet to the suction muffler;
- a back cover coupled to the suction guide; and
- a coupling guide provided in a space defined by the suction guide and the back cover to allow coupling of the suction guide and the back cover, the coupling guide being separate from the suction guide, wherein the coupling guide has a ring shape to surround an outer circumferential surface of the suction guide, and ends of the coupling guide are cut.

2. The linear compressor according to claim 1, wherein an opening is defined between the ends.

3. The linear compressor according to claim 1, wherein the coupling guide includes:
- a first body portion that extends in a first direction;
- a second body portion that extends in a second direction; and
- an inflection portion formed between the first body portion and the second body portion to switch from the first direction toward the second direction.

4. The linear compressor according to claim 3, wherein the ends includes:
- a first end that defines an end of the first body portion; and
- a second end that defines an end of the second body portion.

5. The linear compressor according to claim 3, wherein a line that extends from the inflection portion to the first end and a line that extends from the inflection portion to the second end have a predetermined angle therebetween, and the predetermined angle is less than about 90°.

6. The linear compressor according to claim 1, wherein the coupling guide includes an elastic spring.

7. The linear compressor according to claim 1, wherein the coupling guide is formed of a steel wire.

8. The linear compressor according to claim 1, wherein the back cover includes:
- a cover body having an insertion hole into which the suction guide is inserted, wherein the cover body extends in a first direction;
- a press-fit portion that extends from the cover body in a second direction and into which at least a portion of the suction guide is forcibly press-fitted; and
- a bending portion that extends at a predetermined curvature from the cover body to the press-fit portion.

9. The linear compressor according to claim 8, wherein the coupling guide is provided at a position adjacent to the bending portion.

10. The linear compressor according to claim 9, wherein the suction guide includes:
- a guide body having a cylindrical shape;
- a press-fit corresponding portion that defines at least a portion of an outer circumferential surface of the guide body, wherein the press-fit corresponding portion is pushed by the press-fit portion; and
- a stopper provided on the outer circumferential surface of the guide body to limit a distance by which the guide body is inserted through the insertion hole.

11. The linear compressor according to claim 10, wherein the coupling guide is provided in a space defined by the press-fit corresponding portion, the stopper, and the bending portion.

12. The linear compressor according to claim 10, wherein ends of the coupling guide are cut, and the ends of the coupling guide are provided on an outer circumferential surface of the press-fit corresponding portion.

13. A linear compressor, comprising:
- a shell including a suction inlet;
- a cylinder provided within the shell;
- a piston reciprocated in the cylinder;
- a suction muffler movable together with the piston and having a refrigerant passage;
- a suction guide having a portion provided between the suction inlet and the suction muffler, the suction guide being configured to guide refrigerant to the suction muffler;
- a back cover coupled to the suction guide and including a cover body having an insertion hole into which the suction guide is inserted and a bending portion that extends from the cover body;
- a stopper provided in the suction guide, wherein the stopper is hooked with the back cover; and
- an elastic spring provided in a space between the stopper and the bending portion, the elastic spring having a ring shape and being configured to surround an outer circumferential surface of the suction guide.

14. The linear compressor according to claim 13, wherein the elastic spring has a cut ring shape.

15. The linear compressor according to claim 13, wherein the elastic spring has a twisted shape with respect to the ends thereof.

16. The linear compressor according to claim 13, wherein, when the piston is reciprocated in a forward or backward direction, the suction guide moves in a direction closer to the suction muffler or away from the suction muffler.

17. A linear compressor, comprising:
- a shell including a suction inlet;
- a cylinder provided within the shell;
- a piston reciprocated in the cylinder;

a suction muffler movable together with the piston and having a refrigerant passage;

a suction guide having a portion provided between the suction inlet and the suction muffler, the suction guide being configured to guide refrigerant to the suction muffler;

a back cover coupled to the suction guide and including a cover body having an insertion hole into which the suction guide is inserted and a bending portion that extends from the cover body;

a stopper provided in the suction guide, wherein the stopper is hooked with the back cover; and a steel wire provided in a space between the stopper and the bending portion, the steel wire having a ring shape and being configured to surround an outer circumferential surface of the suction guide.

18. The linear compressor according to claim 17, wherein ends of the steel wire are cut, and an opening is defined between the ends.

19. The linear compressor according to claim 18, wherein the steel wire includes:

a first body portion that extends in a first direction;

a second body portion that extends in a second direction; and an inflection portion formed between the first body portion and the second body portion to switch from the first direction toward the second direction.

20. The linear compressor according to claim 19, wherein the ends includes:

a first end that defines an end of the first body; and a second end that defines an end of the second body, and wherein a line that extends from the inflection portion to the first end and a line that extends from the inflection portion to the second end have a predetermined angle therebetween, and the predetermined angle is less than about 90°.

21. The linear compressor according to claim 17, wherein the back cover further includes:

a press-fit portion into which at least a portion of the suction guide is forcibly press-fitted, wherein the cover body extends in a first direction, and the press-fit portion extends from the cover body in a second direction, wherein the bending portion extends at a predetermined curvature from the cover body to the press-fit portion, and the steel wire is provided at a position adjacent to the bending portion.

22. The linear compressor according to claim 21, wherein the suction guide includes:

a guide body having a cylindrical shape;

a press-fit corresponding portion that defines at least a portion of an outer circumferential surface of the guide body, wherein the press-fit corresponding portion is pushed by the press-fit portion; and a stopper provided on the outer circumferential surface of the guide body to limit a distance by which the guide body is inserted through the insertion hole, and wherein the steel wire is provided in a space defined by the press-fit corresponding portion, the stopper, and the bending portion.

* * * * *